United States Patent [19]

Woolland

[11] 4,354,683

[45] Oct. 19, 1982

[54] GOLFER'S STANCE POSITIONING AID

[76] Inventor: Roderic F. Woolland, 34, Kitchener Ave., Gravesend, Kent, England

[21] Appl. No.: 163,133

[22] Filed: Jun. 26, 1980

[51] Int. Cl.[3] ..... A63B 69/36

[52] U.S. Cl. ..... 273/187 R

[58] Field of Search ..... 273/187 R, 187 A, 187 B, 273/186 C

[56] References Cited

U.S. PATENT DOCUMENTS

| | | | |
|---|---|---|---|
| 2,150,580 | 3/1939 | Crowley | 273/187 R |
| 2,652,251 | 9/1953 | Molinar | 273/187 R |
| 3,610,632 | 10/1971 | Caldwell | 273/187 R |
| 3,638,950 | 2/1972 | Hyotlaine | 273/187 R |
| 4,023,810 | 5/1977 | Lorang | 273/186 C |
| 4,257,608 | 3/1981 | Funk | 273/187 R |

FOREIGN PATENT DOCUMENTS

| | | | |
|---|---|---|---|
| 16930 | of 1911 | United Kingdom | 273/187 R |
| 591840 | 8/1947 | United Kingdom | 273/187 R |
| 839283 | 6/1960 | United Kingdom | 273/187 R |
| 1261524 | 1/1972 | United Kingdom | 273/187 R |
| 1293714 | 10/1972 | United Kingdom | 273/187 R |
| 1461508 | 1/1977 | United Kingdom | 273/187 R |

*Primary Examiner*—George J. Marlo

*Attorney, Agent, or Firm*—Morgan, Finnegan, Pine, Foley & Lee

[57] ABSTRACT

A golfer's aid comprising two elongate members and means for maintaining such two members normal to one another. The members have graduations and markings carried thereon so that one member is located on the ground to point to the ball and the other member is located on the ground to point towards the target. The members are located relative to one another according to the club to be used in accordance with the graduations thereon and markings thereon indicate ideal locations for the feet of the user. The means for maintaining the two elongate members normal to one another can be a plate having four pins and a threaded member centrally located relative to the four pins, each of the members being formed with an elongate slot into which opposed pairs of the pins slidably fit. A nut cooperating with the threaded member clamps the elongate member in the desired position.

2 Claims, 7 Drawing Figures

GOLFER'S STANCE POSITIONING AID

The invention relates to aids for golfers and seeks to provide a device to enable a golfer to establish a stance the correct distance from the ball with ideal feet positions for any club to be used.

According to the invention there is provided a golfer's aid comprising two elongate members and means for maintaining such two members normal to one another and slidable relative to one another, such members having graduations and markings carried thereon such that in use, one member is located on the ground to point towards the ball, the other member is located on the ground to point towards the target, the members are located relative to one another according to the club to be used in accordance with the graduations thereon and markings thereon indicate ideal locations for the feet of the user.

The end of the one member intended to point towards the ball and the end of the other member intended to point towards the target may each be painted. In addition a flexible strip form member may be attached to the end of the one member for locating adjacent the ball.

The means for maintaining the two members normal to one another may comprise a junction box formed with opposed channels into respective ones of which the members are a sliding fit.

Alternatively the means for maintaining the two members normal to one another may comprise a plate having four upstanding members carried thereon, each of the two members being formed with an elongate slot into which opposed pairs of the upstanding members are a sliding fit. Said plate may carry a threaded member in a central location relative to the four upstanding members whereby such threaded member locates through the slots in both the two members and a nut is located thereon to releasably clamp the assembly in a required position.

At least one of the two elongate members may be removable from the means for maintaining the two members normal to one another whereby such two members can be located parallel to one another for transportation purposes.

The foregoing and further features of the invention may be more readily understood from the following description of some preferred embodiments thereof, by way of example, with reference to the accompanying drawings, in which.

Figure 1:
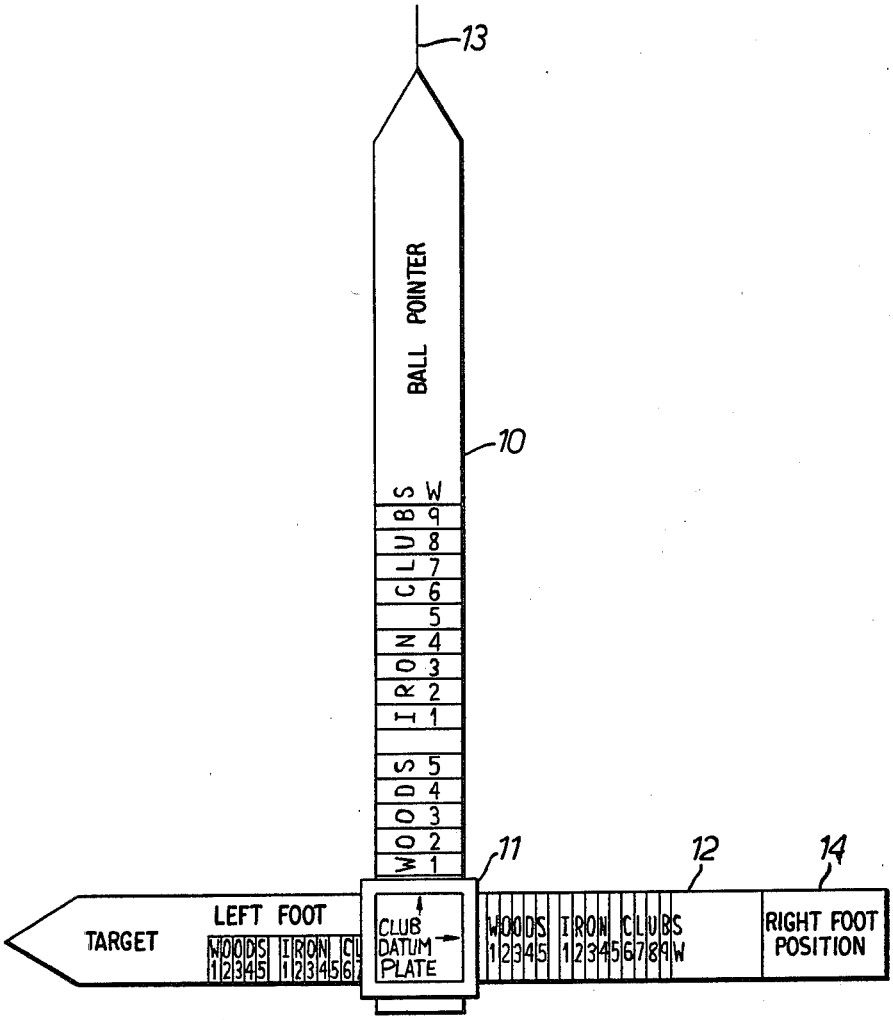
FIG. 1 is a plan view of a golfer's aid.

Referring firstly to FIG. 1 there is shown a golfer's aid comprising a first elongate strip member 10 which is slidably mounted in a channel in a junction box 11 so as to be normal to a second elongate strip member 12 which is also slidably mounted in a further channel in box 11.

The member 10 is pointed at its upper end and carries a flexible strip member for locating adjacent a golf ball, in use.

The member 10 is formed with graduations which commence 41 cm from the outer tip of member 13 and are each 2 cm apart. These graduations are marked for each club and are to be located level with the top of box 11, in use, according to which club to be used, so as to give an ideal distance from ball standing position.

The member 12 has a "right foot position" marked 14 to the right hand end and is pointed at the left hand end which is to pointed towards the required target. The member 12 is formed with graduations to the right hand side of box 11 which commence 37 cm from the centre of marker 14 and are each 1 cm apart. These graduations are to be aligned with the right hand side of box 11 according to the club to be used. The member 12 is formed with a second set of graduations to the left hand side of box 11, the outermost graduation commencing 51 cm from the centre of marker 14 and each being 1 cm apart. These further graduations give the ideal left foot position with the big toe being aligned with the respective graduation for the club being used when the right foot is centrally aligned with marker 14.

The overall size of member 10 is 83 cm long by 32 mm wide by 5 mm thick. The overall size of member 12 is 73 cm long by 32 mm wide by 5 mm thick. The members 10 and 12 may be made of any suitable strip form material, for example aluminium, wood or synthetic plastics.

Figure 2:
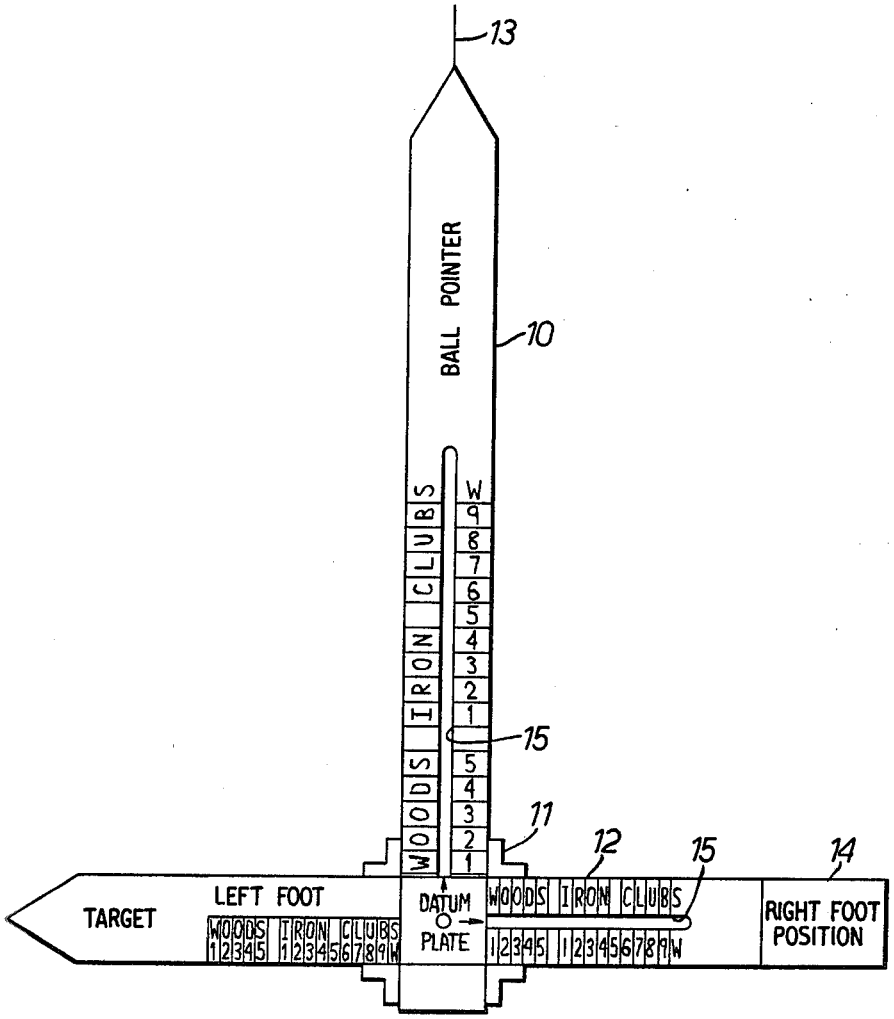
FIG. 2 is a plan view of a modified golfer's aid.

Referring now to FIG. 2 there is shown an alternative device similar to that of FIG. 1 but having a clamping arrangement. Members 10 and 12 are each formed with a slot 15 through which a bolt 16 in box 11 locates. A wing nut is then tightened on bolt 16 to releasably clamp members 10 and 12 in a required location.

Figure 3:
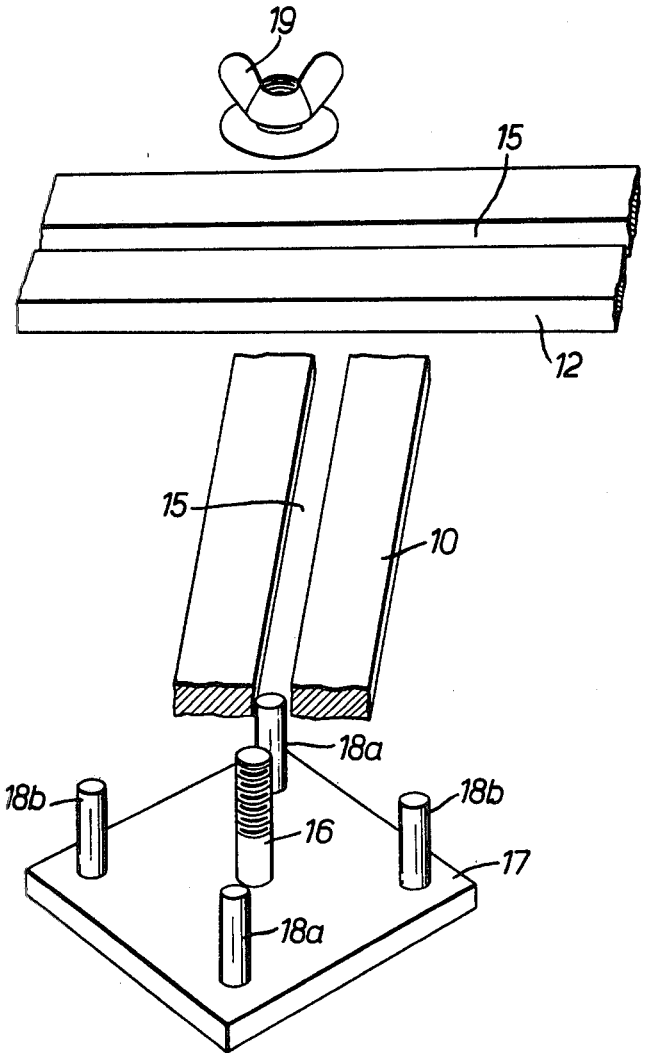
FIG. 3 is an exploded perspective view of an alternative clamping and locating arrangement.

Referring now to FIG. 3 there is shown an exploded perspective view of an alternative clamping and locating arrangement. The box 11 is replaced by a plate 17 having four pins 18 upstanding therefrom. The slot 15 in member 10 locates over pins **18*a* and the slot 15 in member 12 locates over pins 18*b*, such pins also being aligned with the respective graduations to give correct positioning of members 10 and 12. The bolt 16 passes through both slots 15 and nut 19 locates on bolt 16** to clamp the assembly.

In all embodiments the members 10 and 12 can be removed from the clamping and locating assemblies so that they can be aligned parallel and carried in a golf bag.

Figure 5:
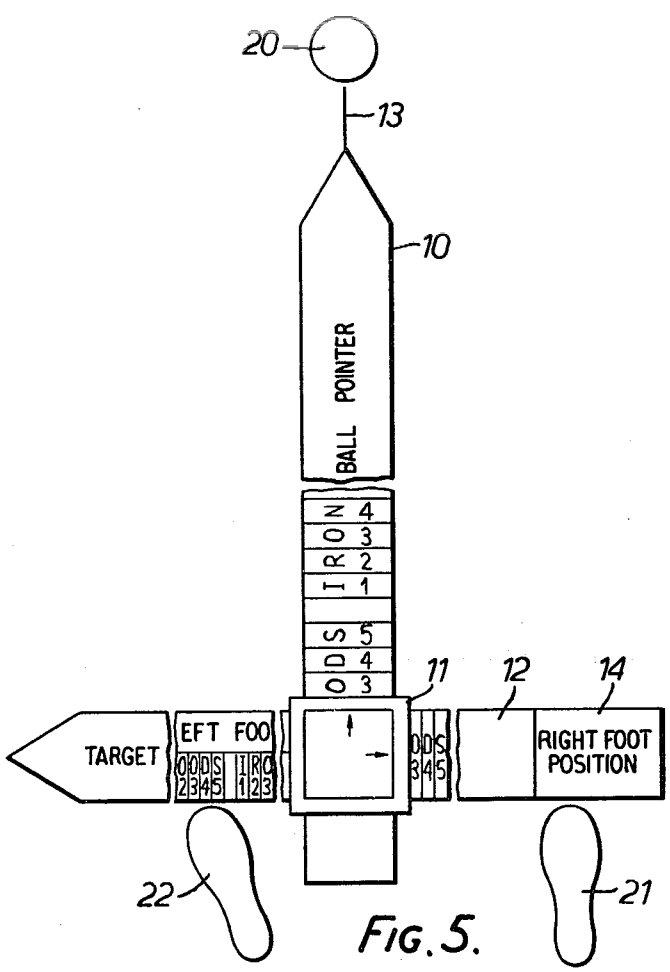
FIGS. 4, 5, 6 and 7 illustrate different foot positions for the stances for use with different clubs.
Figure 4:
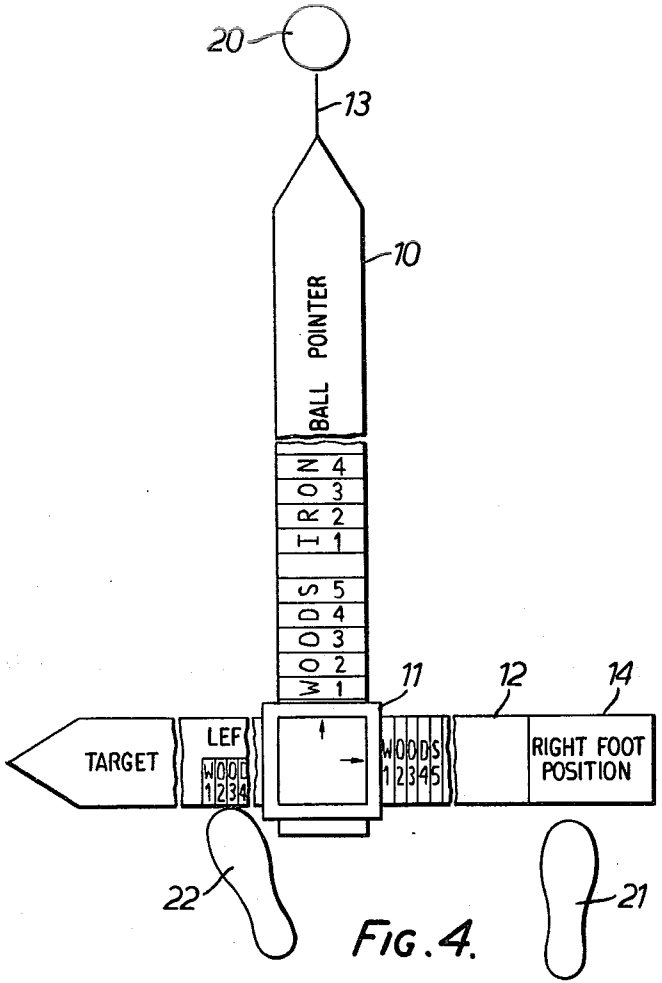
Figure 7:
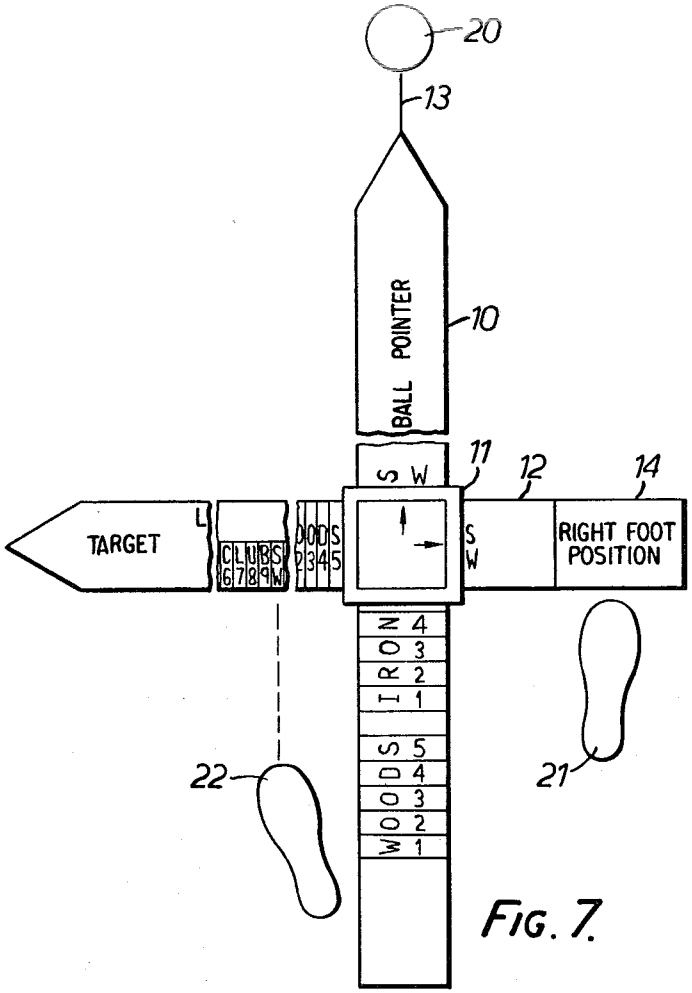
Figure 6:
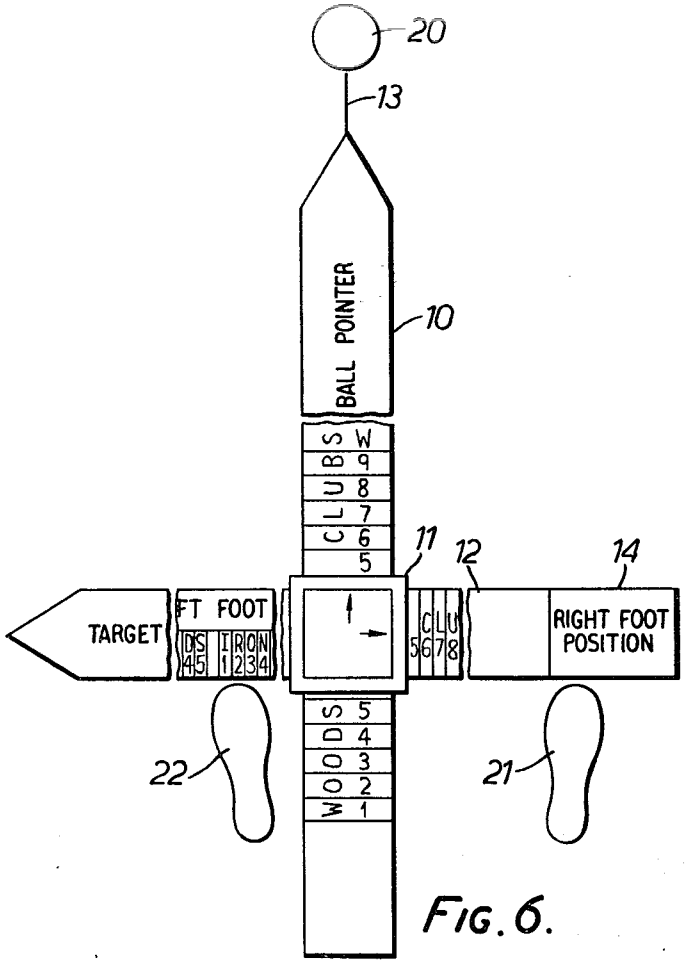

Referring now to FIG. 4 there is shown an example of use of the aid when using a driver club. The ball is shown at 20 with the right foot position at 21 and the left foot position at 22. FIGS. 5, 6 and 7 show similar examples for use of a fairway wood, middle iron and pitching wedge respectively.

The device enables a golfer to provide self instruction and produce repeatable position with respect to distance from ball and feet apart location.

What is claimed is:

1. In a golfer's aid assembly comprising two elongate members and means for maintaining said two members normal to one another and slidable relative to one another, said members also having graduations and markings carried thereon such that, in use, one member is located on the ground to point towards the ball, the other member is located on the ground to point towards the target, and said members being located relative to one another according to the club to be used in accordance with the graduations thereon and markings thereon indicate ideal locations for the feet of the user, the improvement wherein said means for maintaining the two members normal to one another comprises a plate having four upstanding members carried thereon, each of the said two members also having an elongated slot into which opposed pairs of the upstanding members slidably fit, and wherein said plate carries a threaded member in a central location relative to the said four upstanding members whereby said threaded member locates through the slots in the said two members and cooperates with a nut located thereon to releasably clamp the assembly in a required position.

2. A golfer's aid as claimed in claim 1, wherein at least one of the two elongate members is removable from the means for maintaining the two members normal to one another whereby such two members can be oriented parallel to one another for transportation purposes.

* * * * *